US007380896B2

(12) United States Patent
Wada

(10) Patent No.: US 7,380,896 B2
(45) Date of Patent: Jun. 3, 2008

(54) INK JET PRINTING APPARATUS AND INK JET PRINTING METHOD

(75) Inventor: Satoshi Wada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 11/378,489

(22) Filed: Mar. 20, 2006

(65) Prior Publication Data

US 2006/0214957 A1 Sep. 28, 2006

(30) Foreign Application Priority Data

Mar. 24, 2005 (JP) ..... 2005-086720

(51) Int. Cl.
*B41J 29/38* (2006.01)

(52) U.S. Cl. ..... 347/12; 347/13; 347/40; 347/41; 347/42

(58) Field of Classification Search ..... 347/12, 347/13, 41, 42
See application file for complete search history.

(56) References Cited

U.S. PATENT DOCUMENTS

2002/0024557 A1* 2/2002 Matsumoto et al. ..... 347/42
2005/0134617 A1 6/2005 Yamaguchi et al.
2005/0168503 A1* 8/2005 Mitsuzawa ..... 347/5
2005/0275684 A1 12/2005 Yamaguchi et al.
2006/0274099 A1 12/2006 Jahana et al.

FOREIGN PATENT DOCUMENTS

| | | |
|---|---|---|
| JP | 5-238003 | 9/1993 |
| JP | 8-25635 | 1/1996 |
| JP | 2980429 | 9/1999 |
| JP | 2000-289233 | 10/2000 |
| JP | 2002-67320 | 3/2002 |

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

An ink jet printing apparatus carries out printing using a connecting head formed of a plurality of chips connected together, each having an array of nozzles through which ink is ejected. Potential white stripes, which are attributed to connecting portions in each chip, can be suppressed. Each nozzle array is provided with connecting portion nozzles and non-connecting portion nozzles. The connecting portion nozzles in one of the nozzle arrays overlaps the corresponding non-connecting portion nozzles in another nozzle array in a direction in which the nozzle arrays are arranged. Ejection of ink droplets from the non-connecting portion nozzles is controlled in accordance with printing conditions.

13 Claims, 23 Drawing Sheets

| NOZZLE NUMBER | 1 | 2 | 3 | 4 | 5 | 6 | -------- | n-5 | n-4 | n-3 | n-2 | n-1 | n |
|---|---|---|---|---|---|---|---|---|---|---|---|---|---|
| AREA A | 0 | 0 | 1 | 1 | 1 | 0 | -------- | 1 | 0 | 1 | 1 | 0 | 0 |
| AREA B | 1 | 1 | 0 | 0 | 0 | 1 | -------- | 0 | 0 | 1 | 0 | 0 | 0 |

FIG.5

INK JET PRINTING APPARATUS AND INK JET PRINTING METHOD

BACKGROUND OF THE INVENTION

1. Field of the Invention

The present invention relates to an ink jet printing apparatus and method that carries out printing using a connecting head in which a plurality of short chips are arranged in a given direction to form a long head, each of the chips having an array of a plurality of nozzles through which ink is ejected.

2. Description of the Related Art

Printing apparatuses are now used as printers, printers used in copiers or the like, composite electronic apparatuses including computers and word processors, or output apparatuses for workstations. These printing apparatuses are configured to print images (including letters and symbols) on print media such as paper and plastic thin plates on the basis of print information. Various printing apparatuses have been proposed which are based on respective printing strategies. For example, printing strategies such as an ink jet strategy, a wire dot strategy, and a thermal strategy are known to use a print head to form dots on print media on the basis of print information. A known printing strategy using no print heads is a laser beam strategy that irradiates a photosensitive drum with a laser beam on the basis of print information.

The printing strategy using a print head is commonly used owing to the small size and low cost of the corresponding apparatus. A serial type printing apparatus adopts this printing strategy. The serial type printing apparatus carries out printing by moving print media in a given direction (sub-scanning direction) while moving a print head in a direction (main scanning direction) crossing the sub-scanning direction. The serial type printing apparatus moves a relatively short print head over stationary print media in the main scanning direction to print an image of a width corresponding to that of the print head. Once the single main scan is finished, the serial type printing apparatus conveys the print media by a predetermined amount. This operation is repeated to form an image all over the print media.

A full line type printing apparatus adopts another form using a print head. The full line type printing apparatus uses an elongate print head consisting of a large number of ink jet print elements, ejection openings, and liquid paths that are in communication with the ejection openings (these are hereinafter collectively referred to as nozzles). The full line type printing apparatus uses the elongate print head (hereinafter also referred to as a full line head) fixed to the apparatus main body to carry out printing by continuously conveying print media in a direction crossing a longitudinal direction of the print head. This allows one line of image to be printed at a time during one scan operation, thus enabling an image to be quickly formed all over the print media.

Of these printing apparatus using a print head, the ink jet type (ink jet printing apparatus) that carries out printing by ejecting ink from the print head has various advantages as described below. The ink jet printing apparatus facilitates a reduction in the size of the print head, enables high-resolution images to be quickly formed, and requires reduced running costs because of its ability to achieve printing without the need for special processing of ordinary paper. The ink jet printing apparatus also makes reduced noise owing to the use of a non-impact strategy and enables color images to be easily formed using multiple color inks.

In particular, the full line type printing apparatus can further increase image forming speed as previously described because of its ability to achieve a desired print width during one printing operation (hereinafter also referred to as one-pass printing). The full-line type printing apparatus is thus expected to be used for on-demand printing, which is increasingly needed.

On-demand printing does not require several million sheets to be printed during one process as in the case of conventional newspapers and magazines; the printing speed required for on-demand printing is about 100 thousand sheets per hour. However, the manual operation required for on-demand printing needs to be reduced. In this regard, the full-line type printing apparatus is advantageous; in spite of its printing speed lower than that of conventional offset printing apparatuses, the full-line type printing apparatus enables the required manual operation to be reduced because it eliminates the need to produce a printing plate and also enables small amounts of many types of printed matter to be obtained both easily and quickly. Owing to these advantages, the full-line type printing apparatus is optimum for on-demand printing.

The full-line type printing apparatus used for on-demand printing needs to achieve a printing quality typified by a high resolution of 600×600 dpi (dots/inch) for monochromatic print documents such as texts or 1,200×1,200 dpi for full color images such as photographs. The required printing speed is at least 30 pages of A3-size print media per minute.

Moreover, on-demand printing very often involves the printing of print media of several sizes; an image taken using a digital camera or the like may be printed on an L-sized sheet as in the case of conventional silver photographs or on small media such as a postcard.

However, for full-line type print heads, particularly those which enable photographic images to be printed on large-sized sheets, it is very difficult to process the ejection openings and ink jet print elements provided all over the width of a print area without causing any defects. For example, the print head requires about 14,000 ejection openings (print width: about 280 mm) to achieve printing on A3-sized sheets at a density of 1,200 dpi. It is very difficult to process all of the large number of ejection openings and the corresponding ink jet print elements during a manufacture process without causing any defects. If such print heads were successfully manufactured, efficiency percentage would be low and enormous manufacture costs would be required.

Thus, the use of what is called a connecting head H shown in FIGS. 17 and 18 has been proposed for the full-line type ink jet printing apparatus using an elongate print head. The connecting head H is an elongate print head in which a plurality of relatively inexpensive, short chips CH used in serial type ink jet printing apparatuses are precisely arranged. To form a color image using such a connecting head H, a plurality of (in the figure, four) connecting heads H1 to H4 shown in FIG. 19 are arranged in association with a plurality of inks, a cyan (C), magenta (M), yellow (Y), and black (Bk) inks.

As a full-line type print head that can eject four color inks from the same chip, a connecting head has been proposed in which such chips are staggered as shown in FIG. 20. The connecting head shown in FIG. 20 can advantageously have a smaller dimension than the print head configured as shown in FIG. 19, in a direction orthogonal to the direction in which the print heads are arranged.

In each of the print heads H shown in FIGS. 19 and 20, the chips CH are connected together so that their connecting portions are overlapped in the arranging direction. In the connecting head, inks are alternately ejected from the nozzles to land on the print media at the same position. Alternatively, ink ejections from the nozzles are controlled in accordance with a predetermined operating ratio of the nozzles in the connecting portions so that the density of the images printed by the connecting portions is the same as the density of the images printed by the nozzles in non-connecting portions of the connecting head. However, the differences of the characteristics of the nozzles (e.g. landing deviation) tend to cause the image degradation because the image is printed by different nozzles. The connecting portions for the respective colors are also present at the same location in the nozzle arranging direction. Thus, when a color image is formed on print media, inks ejected from the connecting portions for a plurality of colors overlap at the same position on print media. Thus, the degradation of the images printed by the connecting portions is more noticeable than images printed by the non-connecting portions. This may cause a stripe-like density unevenness (connecting stripes). The connecting stripes may degrade image quality.

Thus, for the connecting head configured as shown in FIG. 19, for example, Japanese Patent Application Laid-Open Nos. 5-238003 and 8-25635 disclose a method of avoiding the overlapping of the connecting portions of the respective color print heads as shown in FIG. 21.

For the connecting head in which a plurality of color nozzles are arranged in one chip CH as shown in FIG. 20, a method has also been proposed which avoids the overlapping of the connecting portions of the nozzle array for the same color as shown in FIG. 22 (see Japanese Patent Application Laid-Open No. 2000-289233)

In the print head configured as shown in FIG. 22, the color inks from the connecting portions in the same chip do not overlap. This is expected to make unnoticeable the density unevenness appearing like dense stripes. However, this configuration may cause stripe-like density unevenness (connecting stripes) according to another cause. For example, Japanese Patent Application Laid-Open No. 2002-67320 describes that if the print head shown in FIG. 22 is used to print an image of a high print duty at a high speed, the nozzles in the connecting portions may cause end deviation, resulting in white stripes at the connecting portions. The end deviation is a phenomenon in which an inward shift within the nozzle array occurs in the position where an ink droplet ejected from a nozzle located near an end of the nozzle array lands on the print media. As a measure for solving this problem, Japanese Patent Application Publication No. 02980429 discloses a print head shown in FIG. 23.

In the nozzle shown in FIG. 23, in each of the connecting portions of chips CH, at least one nozzle in one of the chips overlaps at least one nozzle in the other chip. The overlapping nozzles print the same raster. This reduces the print duty of each nozzle to half, thus suppressing the end deviation.

A print head shown in FIG. 8 has also been proposed. The print head includes a plurality of (in the figure, two) connecting heads H1 and H2 that eject the same color ink. In this print head, the connecting portions of the chips CH in the connecting head H1 are displaced from the corresponding connecting portions of the chips CH in the connecting head H2 in the nozzle arranging direction. Such a print head enables a pixel to be printed via a nozzle in one of the connecting heads, which nozzle may cause end deviation, to receive an ink droplet ejected from a normal nozzle in the other connecting head, which nozzle does not cause end deviation. Such a nozzle arrangement has also been disclosed in Japanese Patent Application Laid-Open Nos. 5-238003 and 8-25635.

The printing methods disclosed in Japanese Patent Application Laid-Open Nos. 5-238003 and 8-25635 are effective in visually reducing stripes caused by end deviation if printing is carried out under given printing conditions. However, these printing methods may be ineffective if the amount of end deviation varies as a result of a variation in printing conditions.

SUMMARY OF THE INVENTION

The present invention can provide an ink jet printing apparatus and method that carries out printing using a connecting head formed of a plurality of chips connected together and each having an array of nozzles through which ink is ejected, wherein white stripes that may be caused by connecting portions in each chip are reduced.

A first aspect of the present invention provides an ink jet printing apparatus comprising a print head including a plurality of chips each having at least one nozzle array of a plurality of nozzles through which the same color ink is ejected, the chips being connected together along a direction in which the nozzles are arranged, the print head further including connecting portion nozzles that connect a nozzle array in each chip to a nozzle array in an adjacent chip and non-connecting portion nozzles different from the connecting portion nozzles, the ink jet printing apparatus forming an image by allowing ink droplets to be ejected from the nozzles while relatively moving the connecting head and print media in a direction crossing the nozzle head arranging direction, wherein a plurality of different nozzle arrays are provided in the connecting head in the crossing direction, the connecting portion nozzles in one of the nozzle arrays overlap the non-connecting portion nozzles in the other nozzle array, and control means that controls ejection of ink droplets through the non-connecting portion nozzles in accordance with printing conditions when the connecting portion nozzles and the non-connecting portion nozzles are used to form the same raster extending in the relative moving direction.

A second aspect of the present invention provides an ink jet printing method comprising a print head including a plurality of chips each having at least one nozzle array of a plurality of nozzles through which the same color ink is ejected, the chips being connected together along a direction in which the nozzles are arranged, the print head further including connecting portion nozzles that connect a nozzle array in each chip to a nozzle array in an adjacent chip and non-connecting portion nozzles different from the connecting portion nozzles, the ink jet printing method forming an image by allowing ink droplets to be ejected from the nozzles while relatively moving the connecting head and print media in a direction crossing the nozzle head arranging direction, wherein a plurality of different nozzle arrays are provided in the connecting head in the crossing direction, the connecting portion nozzles in one of the nozzle arrays overlap the non-connecting portion nozzles in the other nozzle array, and control means that controls ejection of ink droplets through the non-connecting portion nozzles in accordance with printing conditions when the connecting portion nozzles and the non-connecting portion nozzles are used to form the same raster extending in the relative moving direction.

In the present invention, the term "printing" is not limited to the formation of significant information such as letters or graphics. The "printing" includes the formation of an image, a pattern, or the like on print media or the processing of media regardless of whether or not the image or pattern is significant or is manifested so that users can visually sense it.

The term "print media" includes not only paper, used in common ink jet printing apparatuses but also cloths, plastic films, metal plates, and other media that can receive ink ejected from the head.

The term "ink" should be broadly interpreted similarly to the term "printing" and includes a liquid applied to print media to form an image, a pattern, or the like or to process print media.

The present invention can reduce white stripes that may be caused by connecting portions of each chip when an image is formed using a connecting head composed of a plurality of chips each having at least one array of a plurality of nozzles and connected together in a direction in which the nozzles are arranged. Thereby, high quality image can be formed.

The above and other objects, effects, features and advantages of the present invention will become more apparent from the following description of embodiments thereof taken in conjunction with the accompanying drawings.

BRIEF DESCRIPTION OF THE DRAWINGS

FIG. 5 is a diagram showing an example of 2-bit selection data corresponding to nozzles;

DETAILED DESCRIPTION OF PREFERRED EMBODIMENTS

Embodiments of the present invention will be described below in detail with reference to the drawings.

First Embodiment

Figure 1:
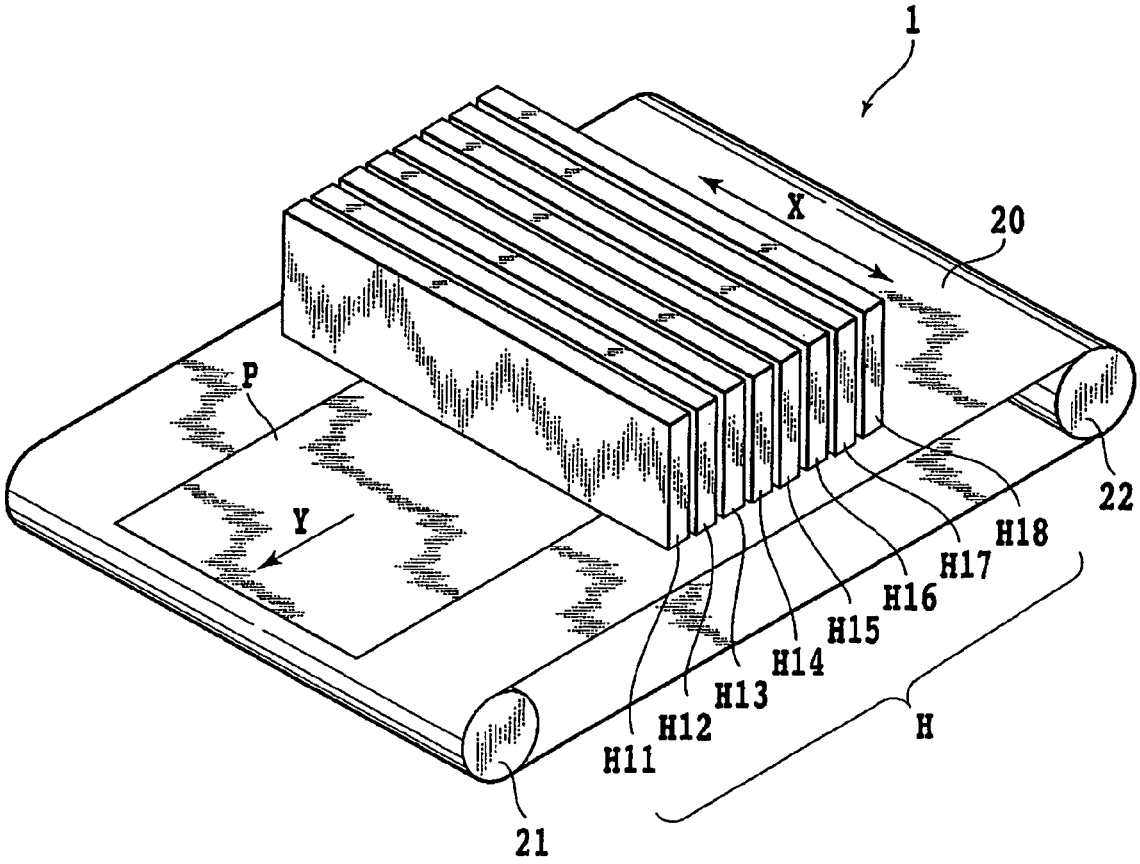
FIG. 1 is a perspective view schematically showing an example of a full-line type ink jet printing apparatus applied to an embodiment of the present invention.

FIG. 1 is a perspective view schematically showing an example of a full-line type ink jet printing apparatus applied to an embodiment of the present invention.

An ink jet printing apparatus 1 has elongate print heads H11 to H18 arranged in association with a plurality of color inks; each of the print heads H11 to H18 has an array of a plurality of ejecting portions (hereinafter also referred to as nozzles). An endless conveying belt 20 is provided along a direction crossing an X direction corresponding to a longitudinal direction (the direction in which the ejection openings are arranged) of the print heads; the endless conveying belt 20 serves as a conveying portion (conveying means) that conveys print media P. The conveying belt 20 is extended around two rollers 21 and 22. One of the rollers is circularly moved by continuously rotating a drive motor (not shown in the drawings), to continuously convey print media in a Y direction.

The ink jet printing apparatus 1 in accordance with this embodiment ejects cyan (C), magenta (M), yellow (Y), and black (Bk) inks to form a color image. Two print heads are arranged for each of the color inks. In FIG. 1, H11 and H12 denote two print heads that eject the cyan ink, H13 and H14 denote two print heads that eject the magenta ink, and H15 and H16 denote two print heads that eject the yellow ink. H17 and H18 denote two print heads that eject the black ink. In the description below, the print heads are collectively denoted by the reference character H if they need not be distinguished from one another.

In the above ink jet printing apparatus, the print media P is fed on the conveying belt 20 by a sheet feeding mechanism (not shown in the drawings). The conveying mechanism and the print heads H11 to H18 have their operations controlled by a CPU in a control system described later. The print heads H11 to H18 eject the inks from the nozzles on the basis of ejection data sent by the control system. The conveying belt 20 conveys the print media P in synchronism with ink ejecting operations in the print heads H11 to H18. The conveyance of the print media P and the ink ejection cause an image to be formed on the print media P.

Figure 2:
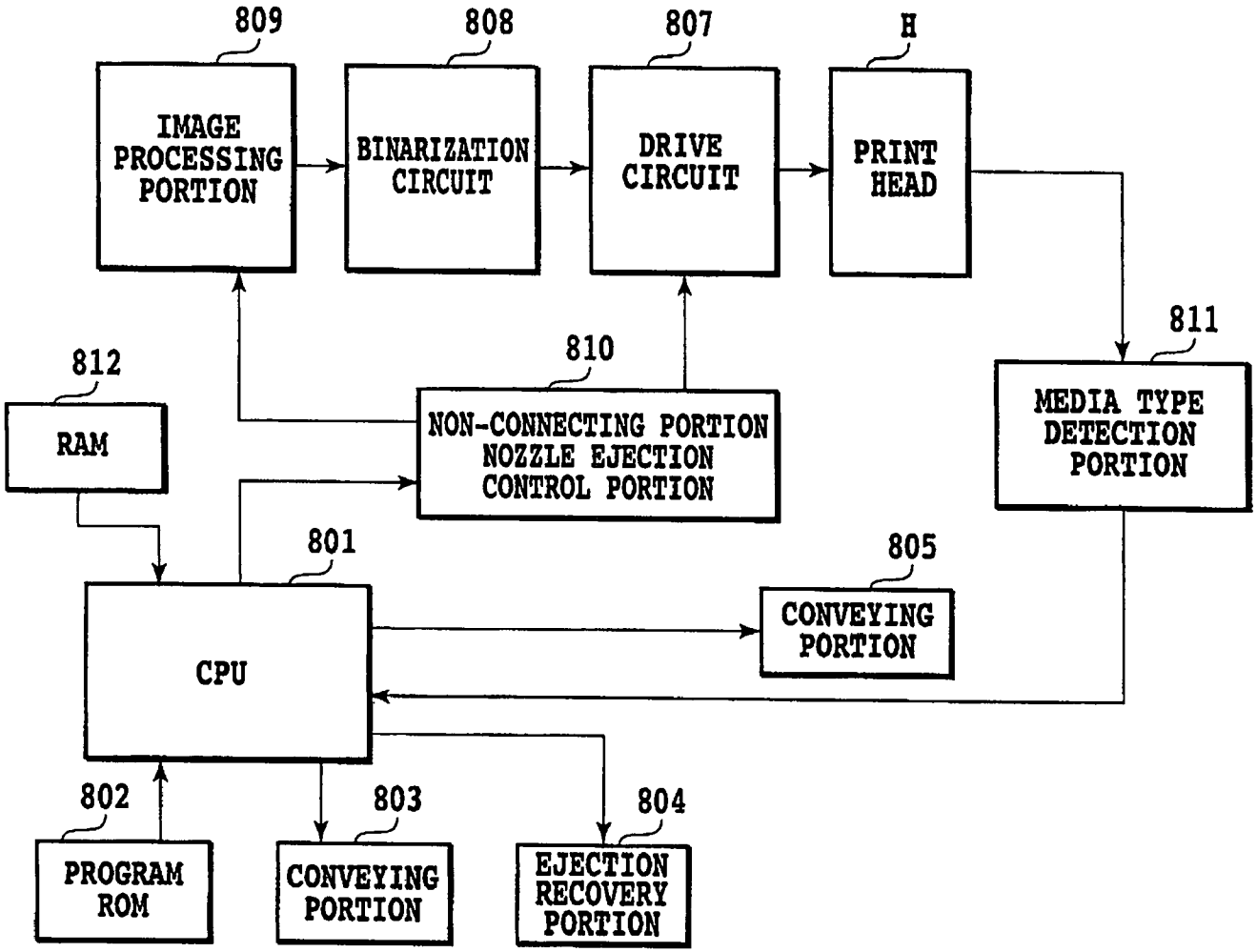
FIG. 2 is a block diagram showing a general configuration of a control system of the ink jet printing apparatus in which the embodiment of the present invention is mounted.

FIG. 2 shows a general configuration of a control system of the ink jet printing apparatus in which the embodiment of the present invention is mounted.

In FIG. 2, reference numeral 801 denotes a CPU that controls the entire system. Reference numeral 802 denotes a ROM in which software programs responsible for system control are written. Reference numeral 812 denotes a RAM that temporarily stores process and input data for the CPU 801. Reference numeral 803 denotes the conveying portion that conveys print media (print sheets, OHP films, or the like). Reference numeral 806 denotes a print head having an array of nozzles through which ink droplets are ejected. Reference numeral 804 denotes an ejection recovery portion that performs an ejection recovery operation on the print head 806.

Reference numeral 809 denotes an image processing portion that executes predetermined image processing on input color image data to be printed. The image processing portion 809 executes data conversion to map a color gamut reproduced by input image data such as R, G, and B to a color gamut reproduced by the printing apparatus. On the basis of the resulting data, the image processing portion 809 further determines color separation data Y, M, C, and K corresponding to a combination of inks that reproduce the colors expressed by the above data. The image processing portion 809 executes gradation conversion on the color separation data on each color. Reference numeral 808 denotes a binarizing circuit which executes a halftone process or the like on multivalued image data obtained through a conversion by the image processing portion 809 and which then converts the image data into ejection data (bitmap data). Reference numeral 807 denotes a drive circuit that causes the print head 806 to eject ink droplets in accordance with ejection data obtained by the binarizing circuit. Reference numeral 811 denotes a media type detecting portion that detects reflected light from print media via a photo sensor to detect the type of the print media on the basis of the detection output.

Now, description will be given of a first embodiment in which a bubble jet (registered trade mark) head is used to eject ink and in which the amount of ink is varied by changing ink droplets from non-connecting portions.

First, description will be given of a basic ejecting operation of the bubble jet (registered trade mark) head, a kind of ink jet head.

The bubble jet (registered trade mark) head uses a strategy of rapidly heating and evaporating ink using heaters to generate bubbles so that the pressure of the bubbles causes ink droplets to be ejected.

The internal structure of each print head H will be described with reference to FIG. 3.

The print head H applied to the present embodiment is roughly composed of a heater board 104 that is a substrate on which a plurality of heaters (electrothermal conversion elements) 102 are formed to heat the inks, and a cover plate 106 placed on the heater board 104. A plurality of ejection openings 108 are formed in the cover plate 106. A tunnel-like liquid path 110 is formed behind each of the ejection openings 108. Each liquid path 110 is isolated from the adjacent liquid path by a bulkhead 112. All the liquid paths 110 are connected to the same ink liquid chamber 114 located behind the liquid paths 110. The ink liquid chamber 114 is supplied with the ink via an ink supply port 116 and then supplies the ink to each of the liquid paths 110. The heater board 104 and the cover plate 106 are aligned and assembled with each other so that the heaters 102 are arranged at positions corresponding to the liquid paths 110. FIG. 3 shows only two heaters 102 but one heater 102 is provided for each liquid path 110.

Figure 3:
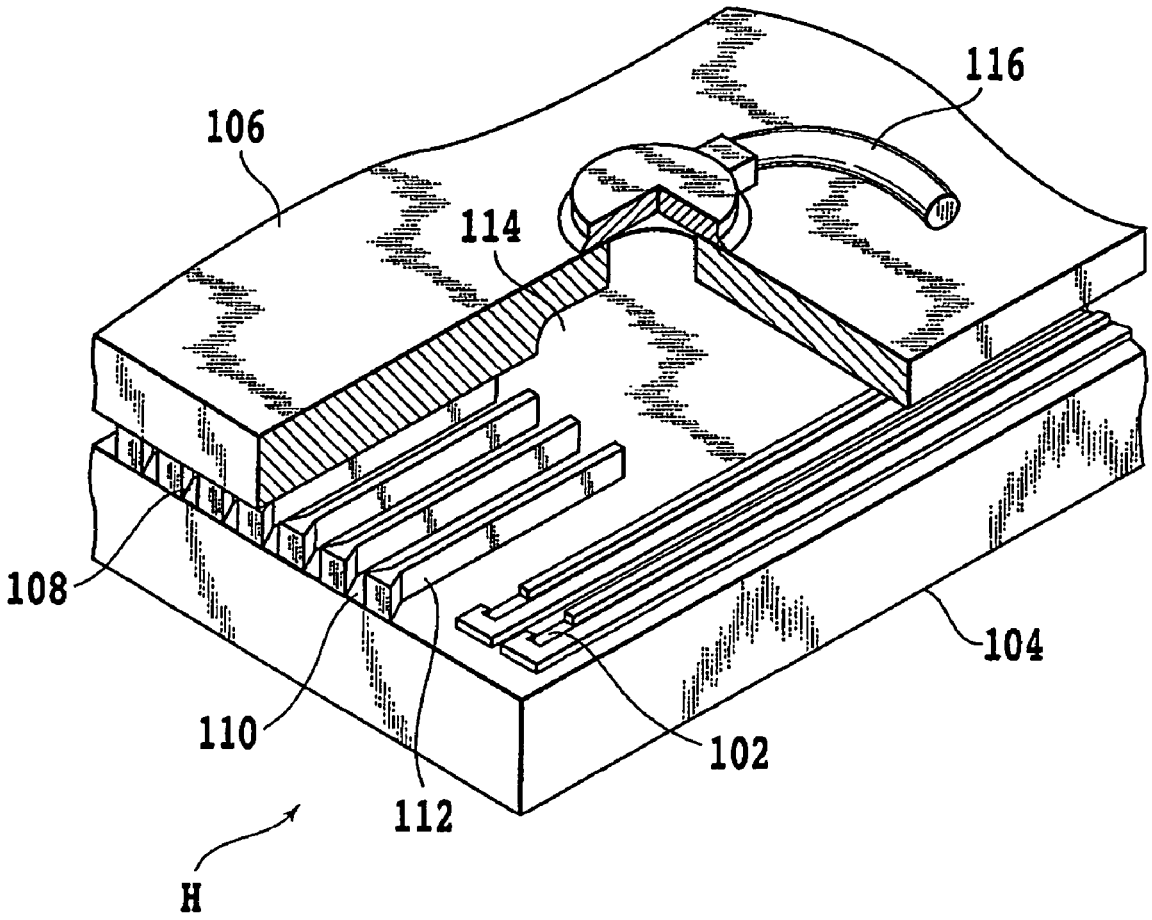
FIG. 3 is a partly cutaway perspective view showing the internal structure of the print head shown in FIG. 1.

With the print head assembled as shown in FIG. 3, supplying a predetermined drive pulse to the heaters 102 causes the ink on the heaters 102 to be boiled to form bubbles. The bubbles then expand to eject the ink from the ejection openings 108.

Description has been given of the principle of ejection of ink droplets from the print head by the use of the electrothermal conversion elements.

The heater board 104 is manufactured from a silicon substrate by a semiconductor process. A signal line via which the heaters 102 are driven is connected to the drive circuit 807 (see FIG. 2) formed on the same substrate. The ejection openings 108, heaters 102, and liquid paths 110 constitute nozzles (ejecting portion).

Now, description will be given of a specific method of changing the amount of ink droplet ejected by the print head (ejection amount).

As described above, the print head ejecting ink droplets using thermal energy of the electrothermal conversion elements rapidly heats the ink with the heaters to generate bubbles in the ink. The bubbles then expand to eject the ink from the ejection openings. Accordingly, the size of the bubbles can be adjusted by controlling the drive pulse applied to the heaters. This enables the control of the amount of ink droplet ejected.

Figure 4A:
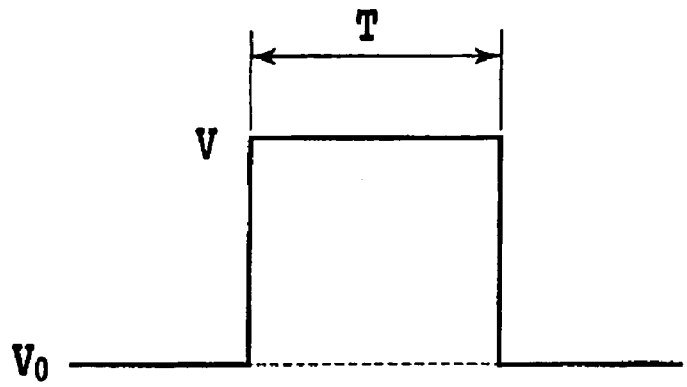
FIG. 4A is a waveform diagram showing the waveform of a drive pulse applied to heaters and used for single pulse driving.
Figure 4B:
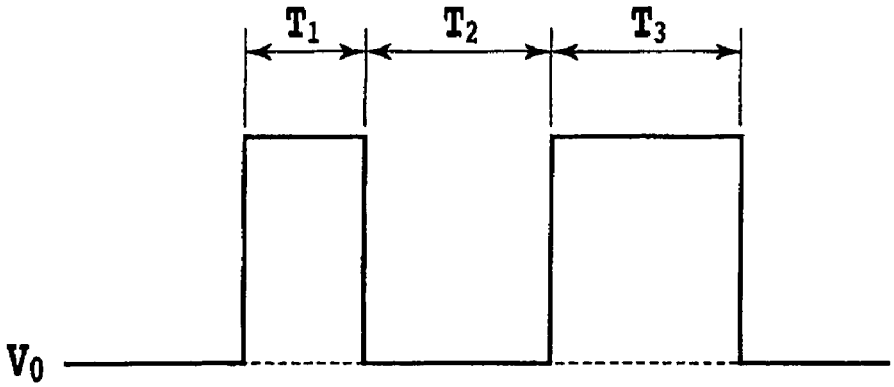
FIG. 4B is a waveform diagram showing the waveform of a drive pulse applied to heaters and used for double pulse driving.

FIGS. 4A and 4B illustrate the waveforms of drive pulses applied to the heaters 102.

FIG. 4A shows a pulse waveform for what is called single pulse driving that applies one drive pulse to the heater to eject one ink droplet from the nozzle. FIG. 4B shows a waveform for what is called double pulse driving that sequentially supplies two pulses to the heater 102 to eject ink droplets from the nozzles.

With the single pulse driving shown in FIG. 4A, the ejection amount can be controlled by changing not only the voltage ($V$-$V_0$) but also pulse width (T). The double pulse driving shown in FIG. 4B enables the ejection amount to be efficiently controlled over a wide range. In FIG. 4B, $T_1$, $T_2$, and $T_3$ denote pre-pulse width, a quiescent period, and main pulse width, respectively.

The reason why the double pulse driving is more efficient than the single pulse driving will be described below. With the single pulse driving, most of heat from the heaters is absorbed by the ink contacting the surfaces of the heaters. A relatively high energy needs to be applied in order to generate bubbles in the ink. In contrast, with the double pulse driving, the application of the pre-pulse enables the ink itself to be heated to some degree. This helps the main pulse generate bubbles later. Thus, the double pulse driving enables the ink to be ejected more efficiently than the single pulse driving.

With the double pulse driving, the ejection amount of nozzles in each overlapping portion can be adjusted by making the pre-pulse width T1 variable with the main pulse width T3 fixed. An increase in T1 increases the ejection amount, whereas a decrease in T1 reduces the ejection amount. Thus, the double pulse driving is desirably adopted to control the ejection amount.

With the double pulse driving, the ejection amount of nozzles in the overlapping portion can be adjusted by making the main-pulse width T3 variable with the pre-pulse width T1 fixed. An increase in T3 increases the ejection amount, whereas a decrease in T3 reduces the ejection amount.

Now, description will be given of a method of controlling the ejection amount in the double pulse driving by assigning different pre-pulses T1 to the respective nozzles.

As shown in FIG. 5, 2-bit data corresponding to the nozzles are written to areas A and B provided in a non-connecting portion nozzle ejection control portion 810 in a control system (see FIG. 2) that controls the print head. The 2-bit selection data enables the selection of a pulse of one of the four pulse widths shown in FIGS. 6A to 6D.

For example, to set the smallest ejection amount, selection data (0, 0) is input to select a pre-pulse PH, with the smallest pulse width. In contrast, to set the largest ejection amount, selection data (1, 1) is input to select a pre-pulse $PH_4$ with the largest pulse width.

Figure 6A:
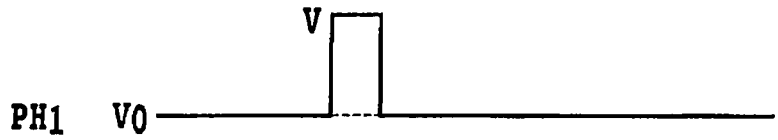
FIGS. 6A to 6D are waveform diagrams showing pre-pulses used for double pulse driving.
Figure 6B:
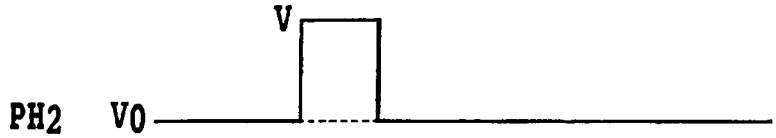
Figure 6C:
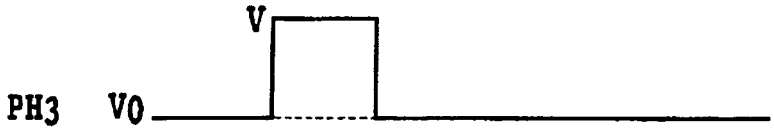
Figure 6D:
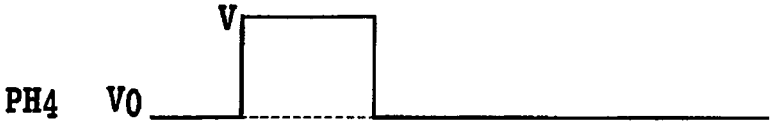
Figure 6E:
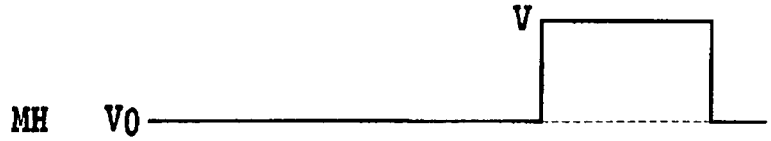
FIG. 6E is a waveform diagram showing a main pulse used for double pulse driving.
Figure 6F:
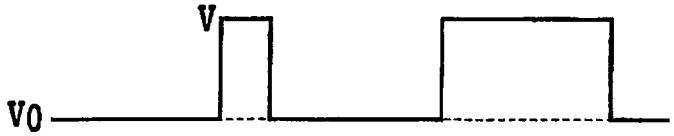
FIGS. 6F to 6I are waveform diagrams showing the synthetic waveforms of the pre-pulses shown in FIGS. 6A to 6D and the main pulse shown in FIG. 6E.
Figure 6G:
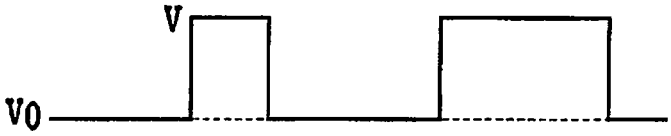
Figure 6H:
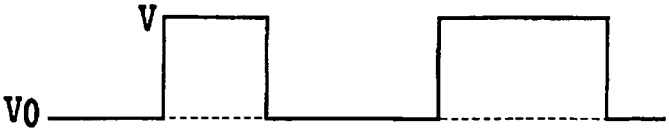
Figure 6I:
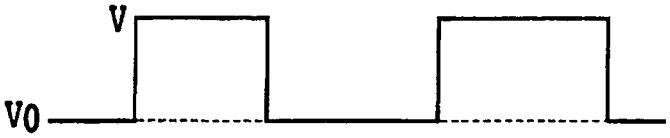

In the first embodiment, the selection data is assigned to each nozzle, and pre-pulses $PH_1$ to $PH_4$ are supplied to the drive circuit 807 for the print head. Moreover, a quiescent time $T_2$ later, a main pulse MH with a given pulse width is supplied to the drive circuit 807. This controls the amount of ink ejected from each nozzle. Thus, after the selected pre-pulse is applied to each nozzle in the print head, the main pulse MH with the given pulse width shown in FIG. 6E is applied. In the above print head, the application of a pre-pulse with a large pulse width increases the quantity of heat generated by the nozzle, thus raising the temperature of the print head.

Now, with reference to FIG. 7, description will be given of the configuration of the drive circuit 807 that enables the ejection amount of each nozzle to be controlled by the double pulse driving as described above.

Figure 7:
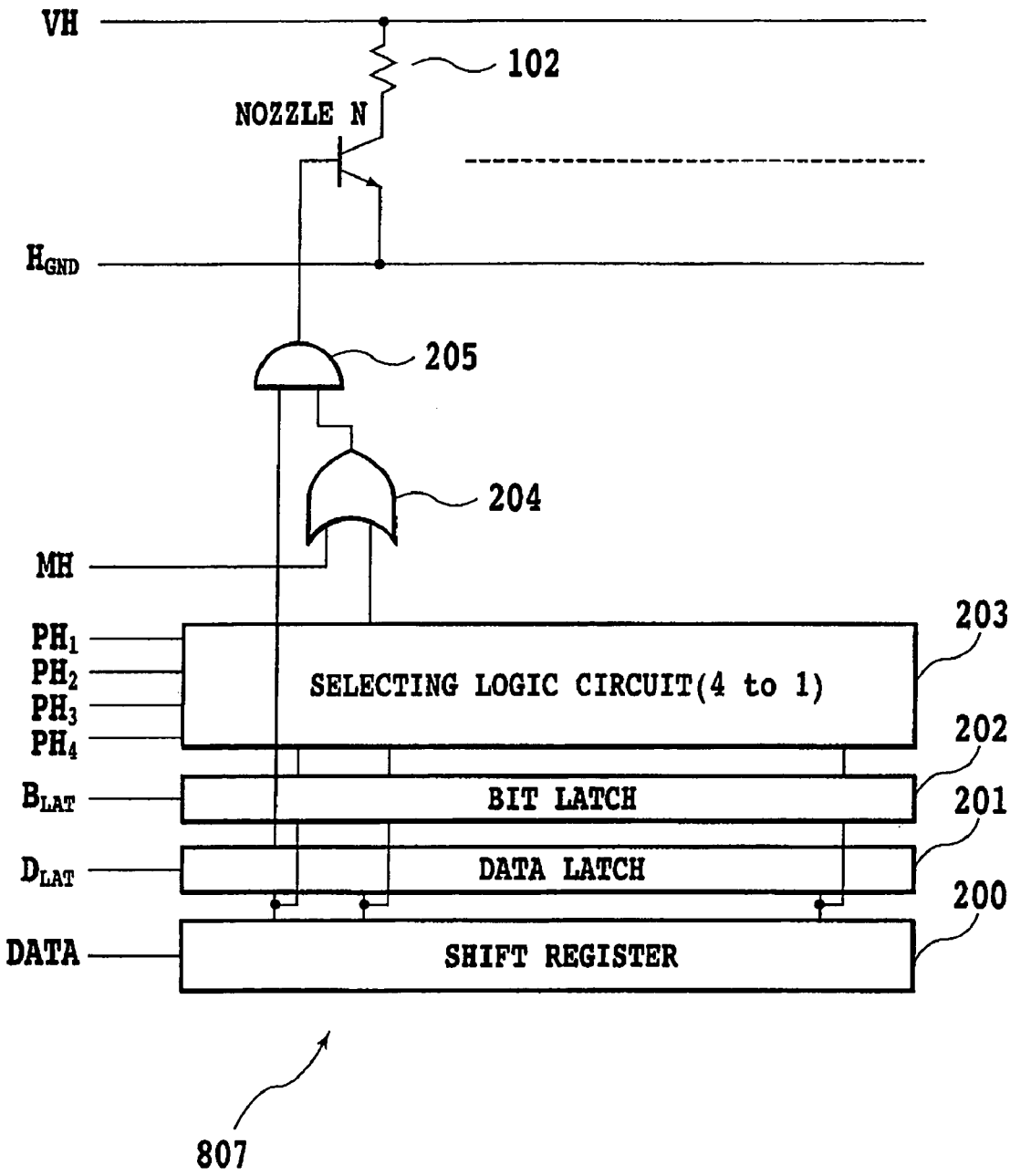
FIG. 7 is a diagram showing the configuration of a print head driving circuit used in a first embodiment of the present invention.

In FIG. 7, VH denotes a power supply line for the ink jet head, $H_{GND}$ denotes a GND line for VH, and MH denotes a signal line for the main pulse signal. $PH_1$ to $PH_4$ denote signal lines for the pre-pulses shown above, and $B_{LAT}$ denotes a signal line that allows a bit latch circuit 202 to latch bit data required to select from the pre-pulse signals $PH_1$ to $PH_4$. $D_{LAT}$ denotes a signal line that allows a data latch circuit 201 to latch data (image data) required for printing. DATA denotes a signal line that allows bit and image data to be transferred to a shift register 200 as serial data.

In the configuration shown in FIG. 7, the bit data (selection data) shown in FIG. 5 is transferred to the shift register 200 through the signal line DATA as serial data for sequential storage. Once the bit data for all the nozzles are transferred to the shift register, a bit latch signal is input to the bit latch circuit 202 through the signal line $B_{LAT}$. The bit data is then latched.

Image data required for printing is then similarly stored in the shift register 200 through a DATA signal line. Once data for all the nozzles are transferred, a $D_{LAT}$ signal is generated to latch data. On the basis of the latched bit data, a selecting logic circuit 203 selects and outputs one of the pre-pulse signals $PH_1$ to $PH_4$. A quiescent time $T_2$ later, the selected pre-pulse signal and the main pulse signal MH are sequentially input to an OR circuit 204 where the signals are synthesized and input to an AND circuit 205. The AND circuit 205 takes the logical AND of the image data from the shift register 200 and the pulse signal from the OR circuit 204. The AND circuit 205 then inputs a signal of a high or low level to a base of a transistor corresponding to the heater 102 in each nozzle. When a high-level signal is input to the transistor, the transistor becomes conductive. A current thus flows through the heater 102, which is thus heated. Ink is consequently ejected from the nozzle. The above process is executed on all the nozzles.

The synthesized waveforms of the pre-pulse signal PH and main pulse signal MH output by the OR circuit 204 are as shown in FIGS. 6F to 6I. The ejection amount can be controlled by sending bit data corresponding to the ejection amount to be obtained, to the shift register at a desired time to change the ejection amount. A method of selecting the pre-pulse signal PH to change the ejection amount of the nozzle is hereinafter referred to as a pre-pulse selection method.

In the above example of driving, 2 bits are used to enable one of the four types of PH pulses to be selected. An increase in the number of bits enables the ejection amount to be more closely controlled. However, this complicates the selecting logic circuit, thus requiring the variable range of the required ejection amount to be determined taking specifications for the entire apparatus into account.

Now, description will be given of a specific method of changing the amount of ink droplet ejected from non-connecting portion nozzles.

Figure 8:
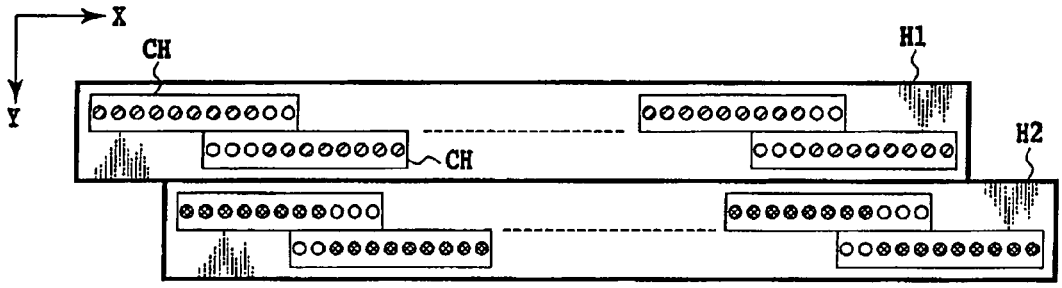
FIG. 8 is a diagram showing the arrangement of nozzles in the print head in accordance with the first embodiment of the present invention.
Figure 9:
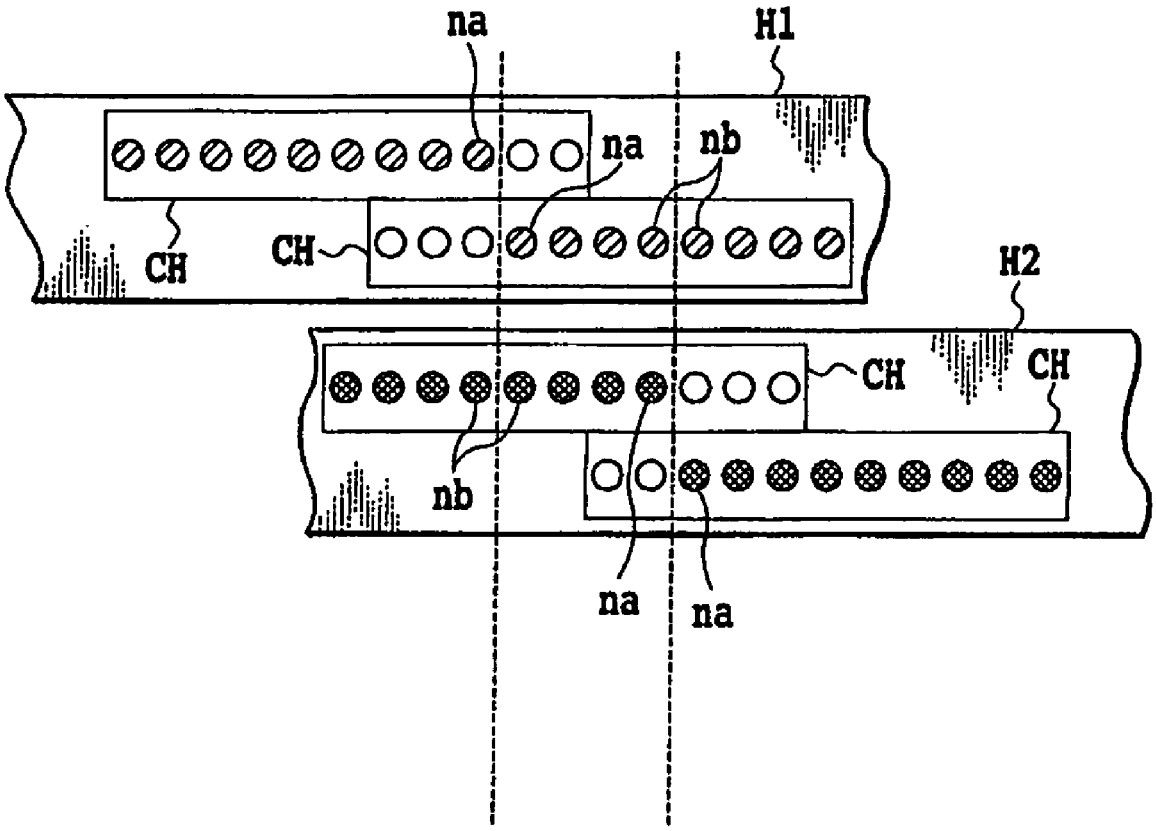
FIG. 9 is a partly enlarged diagram of the nozzles shown in FIG. 8.

FIG. 8 is a diagram showing the arrangement of the nozzles in the print head in accordance with the first embodiment. FIG. 9 is a partly enlarged diagram of the nozzles shown in FIG. 8.

As described with reference to FIG. 1, two print heads (shown by H1 and H2 in FIG. 9) ejecting the same color ink are mounted in the ink jet printing apparatus in accordance with the first embodiment. In this case, nozzle chips CH are staggered and connected together to form each elongate print head (connecting head) extending in the direction (X direction) crossing the direction (Y direction) in which print media are conveyed; each of the nozzle chips has an array of a plurality of nozzles arranged along the X direction. In each of the print heads shown in FIG. 8, each of the nozzle chips CH is placed so that some of its nozzles overlap some of the nozzles in the adjacent nozzle chip CH. However, to actually form an image, the present embodiment carries out printing so as to prevent the nozzles used from overlapping one another as shown in FIG. 9. Specifically, in the connecting head H1, nozzles with internal diagonal lines are used, whereas, in the print head H2, nozzles with internal nodal lines are used. Accordingly, a nozzle na located at each end of the nozzles used in each chip CH serves as a connecting portion nozzle for the adjacent chip CH.

In the present embodiment, as shown in FIG. 9, each of the connecting portion nozzles na in one H1 of the connecting heads is located at a position different from that of the corresponding connecting portion nozzle na in the other connecting head H2 in the nozzle arranging direction (so as to prevent the connecting portion nozzles from overlapping).

With the above connecting heads, what is called end deviation may occur in which ink droplets ejected from the connecting portion nozzles na in each chip CH are displaced from their regular landing positions. Experiments have clarified that the amount of end deviation varies depending on printing speed (the substantial ejection frequency of the nozzles) or print duty. The end deviation occurring in each chip is observed to be always directed toward the central nozzle of the nozzle array formed in the chip CH. Consequently, whenever an image is formed by causing ink droplets to be ejected from the connecting portion nozzles na similarly to the other nozzles not subjected to end deviation, white stripes occur at joints in the image formed by the connecting portion nozzles na.

Figure 10A:
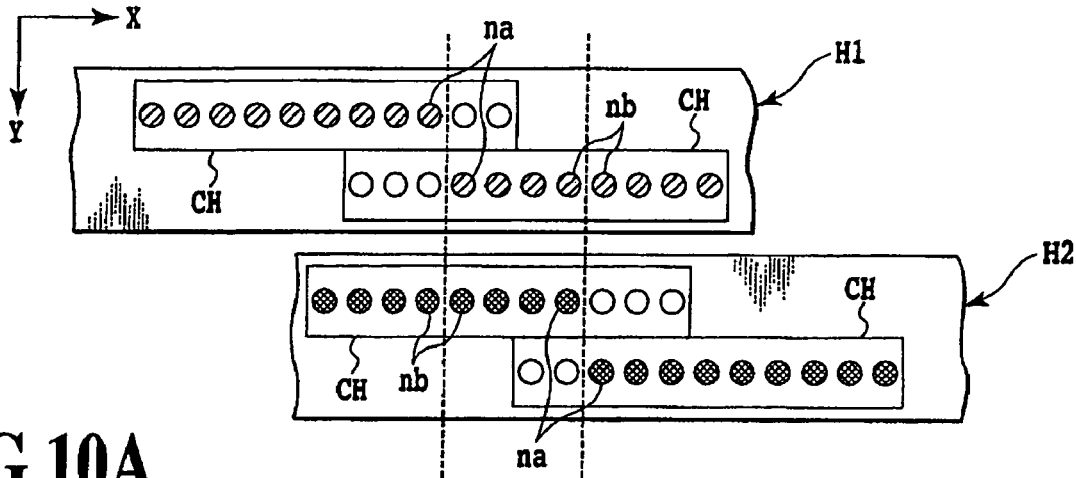
FIG. 10A is a partly enlarged diagram of the connecting head shown in FIG. 8.
Figure 10B:
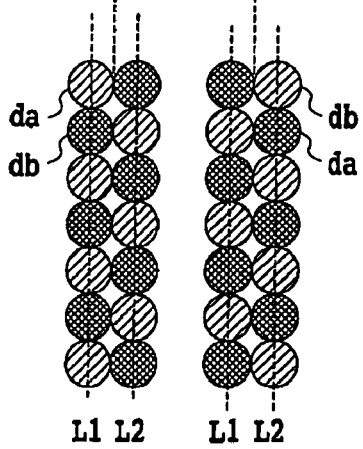
FIG. 10B is a diagram showing ideal dots formed using the connecting head shown in FIG. 8.

FIG. 10A shows the print heads used in the present embodiment. FIG. 10B shows ideal dots formed by ink droplets ejected from the nozzles used and landing on the correct positions so that the end deviation does not occur at any of the nozzles used. In FIG. 10A, H1 and H2 denote connecting heads similar to those in FIG. 9.

In this case, the connecting heads H1 and H2 alternately eject ink droplets to print media conveyed in the Y direction to form each raster. That is, each raster extending in the Y direction is formed by alternately using the appropriate nozzles in the connecting heads H1 and H2 to form dots (the dots formed using the connecting head H1 are shown with internal diagonal lines, whereas the dots formed using the connecting head H2 are shown with internal nodal lines).

In FIG. 10B, da denotes a dot formed using a connecting portion nozzle na, and db denotes a dot formed using a non-connecting nozzle nb. As shown in the figure, for the connecting portions between the chips CH, a raster is formed by alternately using the connecting nozzles na in one of the print heads and the connecting nozzles nb in the other print head to form dots. In the illustrated ideal dot formation, all the dots da and db have their center positions located on the same line in a raster direction (Y direction). This avoids the creation of a white stripe between two rasters L1 and L2 formed at the connecting portion between the chips.

Figure 11A:
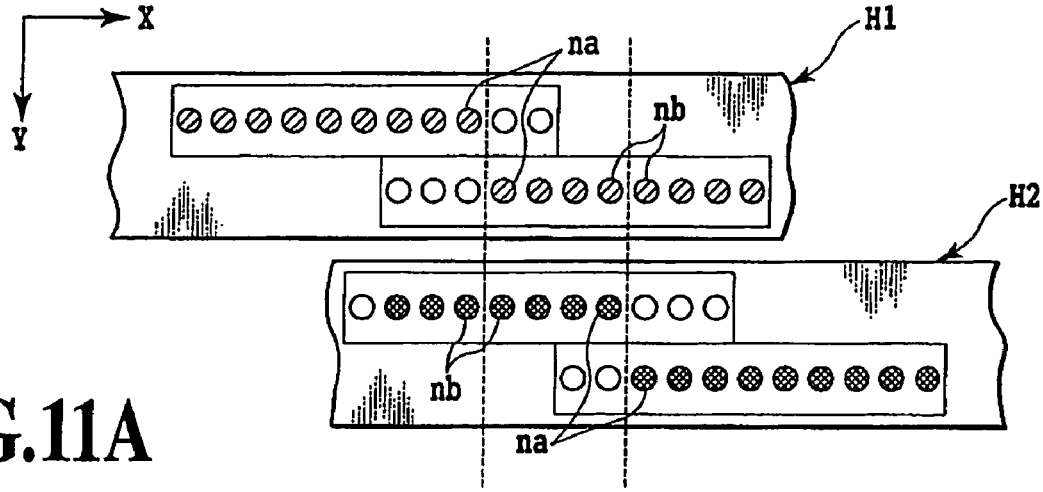
FIG. 11A is a partly enlarged diagram of the print head shown in FIG. 8.
Figure 11B:
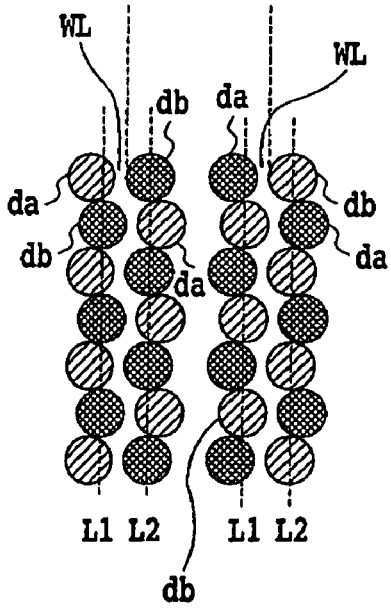
FIG. 11B is a diagram showing dots formed on print media by an actual printing operation.

However, the end deviation may occur at the connecting portion nozzle na during an actual printing operation, thus preventing the formation of the ideal image shown in FIG. 10B. FIG. 11B shows dots formed on print media by an actual printing operation.

As shown in FIG. 11B, ink droplets ejected from the non-connecting portion nozzles nb are not subjected to the end deviation and land on the print media at the correct positions to form dots da. In contrast, ink droplets ejected from the connecting portion nozzles na are subjected to the end deviation. Consequently, the center position of each dot da is displaced in the X direction, thus enlarging the spacing between the dot da and the corresponding dot db in the adjacent raster. This reduces the density of the portion between the two adjacent rasters L1 and L2 formed at the connecting portion. This portion is recognized as a white stripe WL in the entire image. Further, the amount of end deviation varies depending on printing conditions such as the printing speed and print duty as previously described. Thus, the extent of the white stripe WL also varies depending on the printing conditions.

Thus, the first embodiment prevents the occurrence of the white stripe WL not only by improving the configuration of the print head (nozzle arrangement and printing strategy) as in the case of the above patent documents but also by executing image correction taking the above printing conditions into account. This enables image formation with the white stripe made more visually unnoticeable.

Figure 12A:
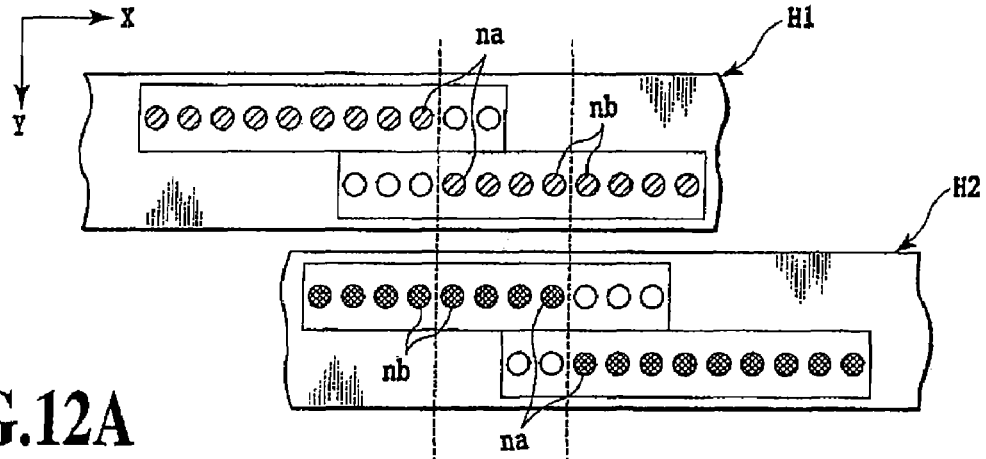
FIG. 12A is a partly enlarged diagram of the connecting head shown in FIG. 8.
Figure 12B:
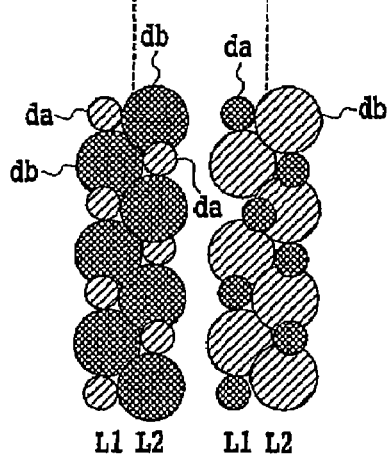
FIG. 12B is a diagram showing dots formed in accordance with the first embodiment.

FIG. 12B is a diagram showing dots formed in accordance with the first embodiment. As shown in FIG. 12B, the first embodiment varies the ejection amount of the non-connecting portion nozzle nb adjacent to the connecting portion nozzle na depending on the printing conditions. The ejection amount of the non-connecting portion nozzle is controlled using the previously-described pre-pulse selection method. That is, the pre-pulse applied to the non-connecting portion nozzle nb adjacent to the connecting portion nozzle na is selected to increase the ejection amount of the non-connecting portion nozzle nb and thus the diameter of dots formed by ink droplets ejected from the non-connecting portion nozzle nb. This enables the coverage of a wider area of a white stripe resulting from the end deviation of ink droplets ejected from the connecting portion nozzle na. The white stripe can thus be made unnoticeable. The first embodiment further performs control such that the ejection amount of the connecting portion nozzle na subjected to the end deviation (deviation of the landing position) is reduced, to set the density of the entire image at an appropriate value.

To thus control the ejection amount, the present embodiment experimentally checks the level of end deviation to which each connecting portion nozzle na is to be subjected, on the basis of the printing conditions. The check results are saved, as end deviation information, to the RAM 812, shown in FIG. 2, or a memory of the non-connecting portion nozzle ejection control portion 810, also shown in FIG. 2. Upon receiving image data to be printed, the CPU 801 sets the pre-pulse for the non-connecting portion nozzle nb corresponding to each of the connecting portion nozzles na in each connecting head on the basis of the end deviation information, to change the ejection amount of the non-connecting portion nozzle nb.

The actual amount of end deviation is greatly varied by the printing speed or print duty described above and also varies significantly depending on the spacing between the print head and print media. Accordingly, the setting of end deviation information based on the printing conditions is desirably carried out when definite specifications for the apparatus are available.

In the above embodiment, the ejection amount is varied by switching the pulse width of the pre-pulse PH. In this case, voltage is fixed but can of course be varied instead of the pulse width to exert similar effects. It is also possible to fix the pre-pulse width while varying the pulse width of the main pulse MH and thus the ejection amount, though efficiency is slightly degraded compared to that achieved by varying the pre-pulse width.

In the above embodiment, the printing conditions for the control of ejection amount of the non-connecting nozzles are the printing speed, the print duty, and the spacing between the print head and print media, which are set in the printing apparatus. However, the type of print media applied to the printing apparatus can be effectively used as a printing condition. White stripes formed in an image offer viewing levels varying significantly depending on the type of the print media. For example, on media (for example, glossy paper) the surface of which is coated, white stripes invisible on ordinary paper are clearly visible. That is, glossy paper or the like requires stricter control to avoid white stripes. Thus, to achieve stricter control depending on the type of print media or the like, a print media type detection sensor comprising a photo sensor shown at 811 in FIG. 2 is used to detect the type of the print media used. The control of ejection from the non-connecting portion nozzles na can also be automatically changed taking the type of print media into account. As the printing conditions, not only the type of the print media but also the type of the inks can also be effectively taken into account. This is because some inks diffuse (bleed) differently on the same print media. Moreover, the relationship between the inks and the print media may also be used as a printing condition.

In the example described above, even if nozzles in one chip physically overlap nozzles in the adjacent chip, the nozzles located in the overlapping portion do not overlap in the actual formation of an image. However, the present invention is not limited. In one form of the present invention, nozzles in one chip which are used for image formation may overlap nozzles in the adjacent chip which are used for image formation.

Second Embodiment

Now, a second embodiment of the present invention will be described with reference to FIGS. 13A and 13B. The present embodiment also comprises the configuration shown in FIG. 1 or 2. A print head shown in FIG. 13A is similar to that in accordance with the first embodiment in the arrangement of nozzles and the setting of nozzles used.

The first embodiment changes the amount of ink droplet from the non-connecting portion nozzles to make white stripes unnoticeable. Instead, the second embodiment changes the number of ink droplets ejected from the non-connecting portion nozzles to reduce possible white stripes.

Figure 13A:
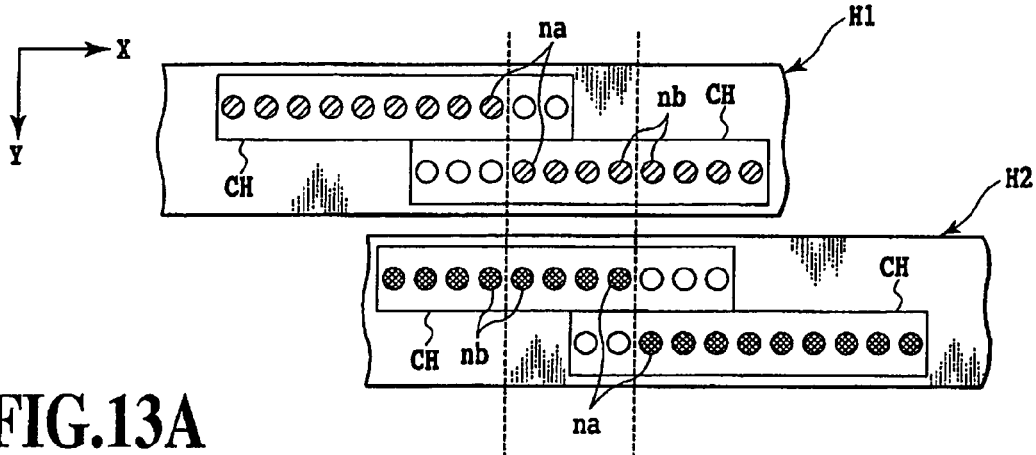
FIG. 13A is a partly enlarged diagram of a print head used in a second embodiment of the present invention.
Figure 13B:
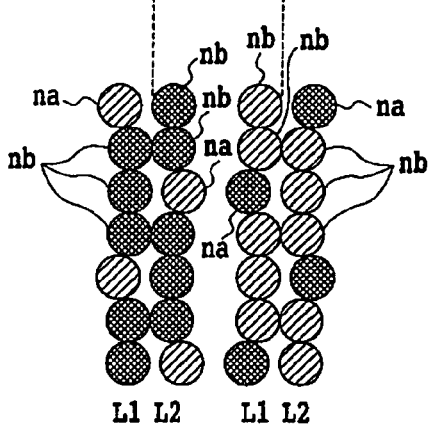
FIG. 13B is a diagram showing dots formed in accordance with the second embodiment.

Specifically, in forming rasters using the connecting portions between the chips CH in the connecting heads H1 and H2 shown in FIG. 13A, the second embodiment increases the number of dots formed using the non-connecting portion nozzle nb while reducing the number of dots formed using the connecting portion nozzle na. In FIG. 13B, for one raster, the non-connecting portion nozzles nb are used to form a plurality of dots (in the figure, a maximum of three dots) before and after each connecting nozzle portion na.

This image formation allows the non-connecting portion nozzles nb to apply more ink droplets to the vicinity of each part of print media to which no ink is applied owing to the end deviation attributed to the connecting portion nozzles na. The spread of the ink can suppress possible white stripes. A decrease in the number of ink droplets from the connecting portion nozzles also serve to suppress possible white stripes.

In the above driving control of the nozzles, the numbers of ink droplets ejected from the non-connecting and connecting portion nozzles nb and na are determined in accordance with given printing conditions. The relationship between the printing conditions and the number of ink droplets to be ejected from each nozzle is experimentally predetermined and saved to the memory. During printing, the CPU 801 reads the numbers of ink droplets corresponding to the set printing conditions. The CPU 801 then changes the numbers of ink droplets ejected from the nozzles na and nb by transmitting a predetermined control signal to the drive circuit 807 through the non-connecting portion nozzle ejection control portion 810. The number of ink droplets ejected can be changed by, for example, switching binary print data read from a print buffer corresponding to each print head, before the print data is input to the shift register 200. Specifically, if print data corresponding to the non-connecting portion nozzle instructs the ejection of ink droplets to be avoided (for example, the print data is "0"), it is switched to data instructing the ink droplets to be ejected (for example, the data is "1"), which is then sent to the shift register 200. This enables an increase in the number of ink droplets ejected. In contrast, if print data corresponding to the connecting portion nozzle instructs ink droplets to be ejected (f or example, the print data is "1"), it is switched to data instructing the ejection of ink droplets to be avoided (for example, the data is "0"), which is then sent to the shift register 200. This enables a reduction in the number of ink droplets ejected. A drive circuit used for the second embodiment corresponds to the drive circuit shown in FIG. 7 from which the bit latch circuit 202, selecting logic circuit 203, and OR circuit 204 are deleted and in which a signal from the data latch circuit 201 and a heat pulse signal are input to the AND circuit 205. The present embodiment thus enables the configuration of the drive circuit to be simplified.

The number of ink droplets ejected from each nozzle can also be changed by pre-altering print data stored in the print buffer corresponding to each print head, depending on the printing conditions.

Of course, the second embodiment may also use the type of print media as a printing condition so that the number of ink droplets can be controlled depending on the type of the print media.

Third Embodiment

To suppress possible white stripes attributed to the connecting nozzle na, the first embodiment changes the amount of ink droplet ejected from the non-connecting and connecting portion nozzles nb and na, whereas the second embodiment increases the number of ink droplets ejected from the non-connecting and connecting portion nozzles nb and na. In contrast, the third embodiment combines the controls performed by the first and second embodiments. A comparison of the ejection amount controls of these embodiments indicates that the second embodiment, which changes the number of ink droplets, enables the amount of ink ejected onto print media to be changed more significantly than the first embodiment. However, if the number of droplets is controlled as with the second embodiment, it is difficult to strictly control the ejection amount. Thus, the third embodiment combines the first and second embodiments so that the ejection amount and the number of ink droplets ejected are appropriately controlled depending on the ejection amount required for interpolation. This makes it possible to deal with the interpolation over a wider dynamic range.

Fourth Embodiment

Figure 14A:
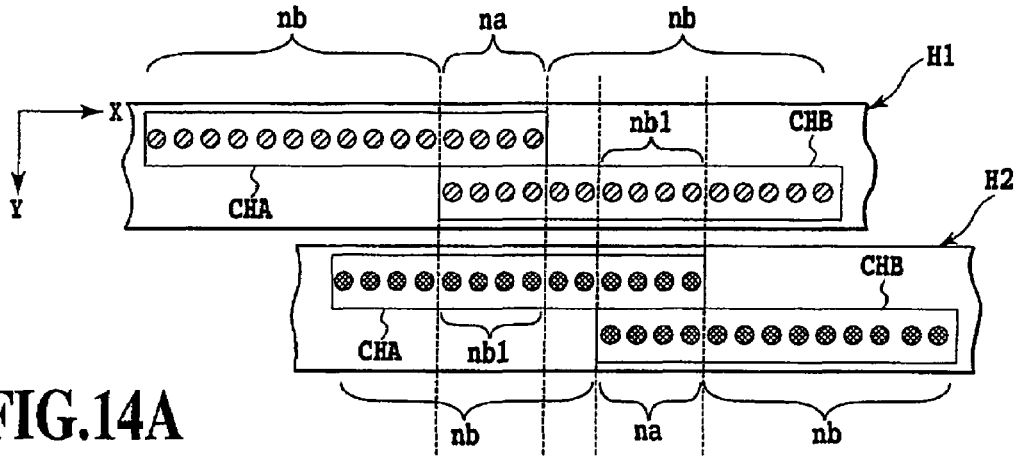
FIG. 14A is a diagram showing a connecting head in accordance with a third embodiment of the present invention.

In the example described in the first to third embodiments, in each of the connecting heads H1 and H2, the connecting portion nozzles na in each chip do not overlap the connecting portion nozzles na in the adjacent chip. In the fourth embodiment, in each of the heads H1 and H2, nozzles used in a chip CHA overlap nozzles used in an adjacent chip CHB, at the connecting portion between the chips CHA and CHB. In the example shown in FIG. 14A, all the nozzles in both chips CHA and CHB are set to be used, with four nozzles in each chip serving as connecting nozzles na. nb denotes a non-connecting nozzle.

Figure 14B:
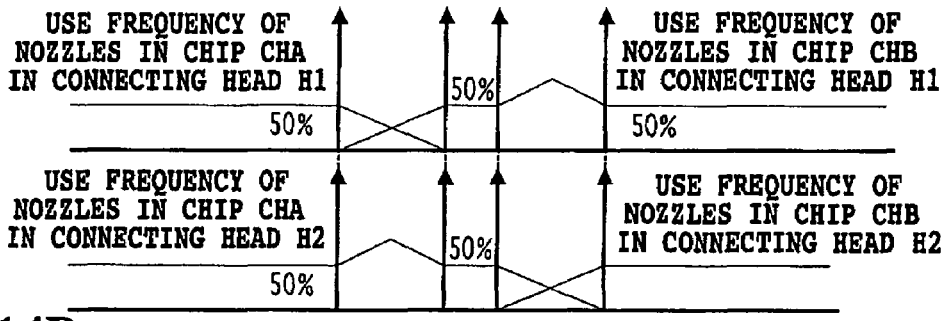
FIG. 14B is a diagram showing how frequently nozzles in each of the print heads shown in FIG. 14A are used to form an image.

FIG. 14B shows how frequently the nozzles in each print head are used to form an image. The nozzles in each of the heads H1 and H2 deal with half of the image data on the same raster (50% duty). For the four connecting portion nozzles na in each of the chips CHA and CHB in the print head H1, nozzles closer to an end of the chip have lower use frequencies. This is intended to reduce the adverse effect of the nozzles closer to the end of the chip, which cause a larger amount of end deviation. Of the non-connecting portion nozzles nb in each connecting head, a nozzle nb1 located to overlap the corresponding connecting portion nozzle na in the other print head has an increased use frequency of at least 50%. This makes it possible to suppress white stripes that may result from end deviation attributed to the connecting portion nozzle na. By combining the above ejection control with the control of the ejection amount and/or the control of the number of ink droplets ejected, described in the first and second embodiment, it is possible to make white stripes unnoticeable as with these embodiments.

Fifth Embodiment

Figure 15:
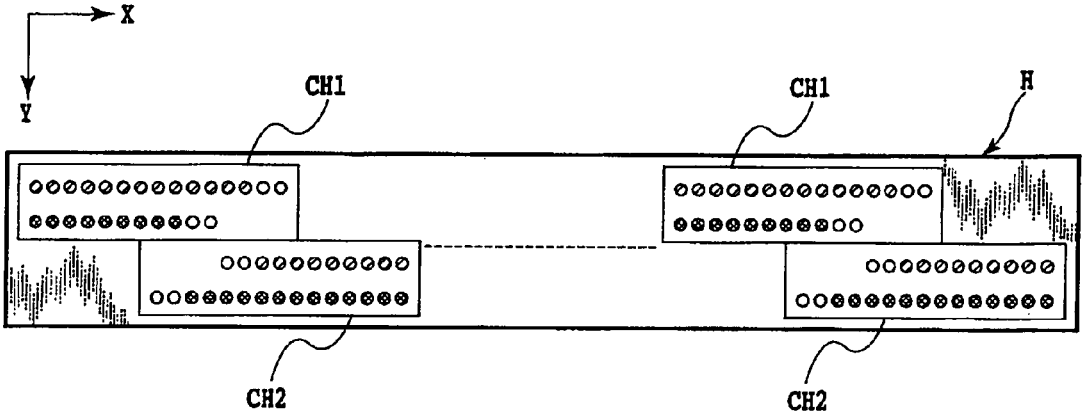
FIG. 15 is a diagram showing a print head used in a fifth embodiment of the present invention.
Figure 16A:
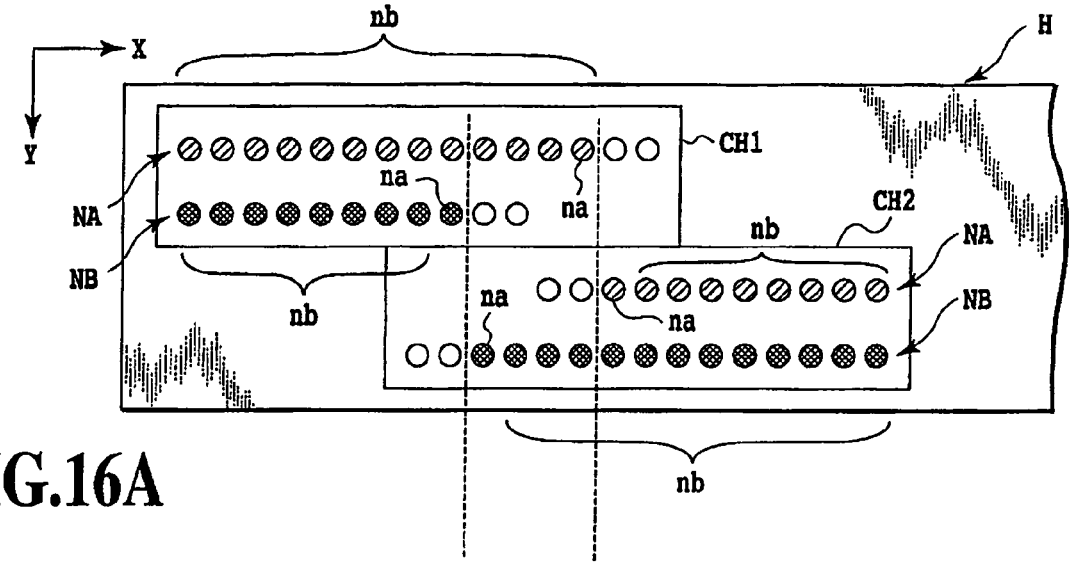
FIG. 16A is an enlarged diagram showing chips and a nozzle arrangement in the print head shown in FIG. 15.
Figure 16B:
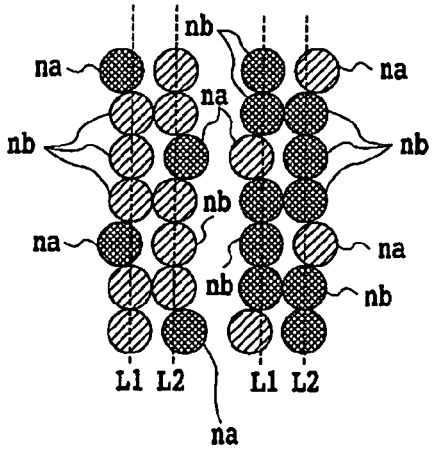
FIG. 16B is a diagram illustrating the arrangement of dots formed in accordance with the fifth embodiment of the present invention.
Figure 17:
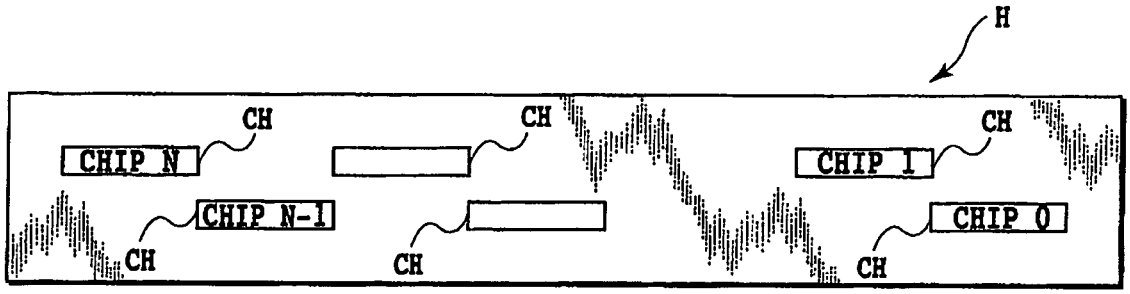
FIG. 17 is a diagram showing the arrangement of chips in a connecting head used in a conventional full-line type ink jet printing apparatus.
Figure 18:
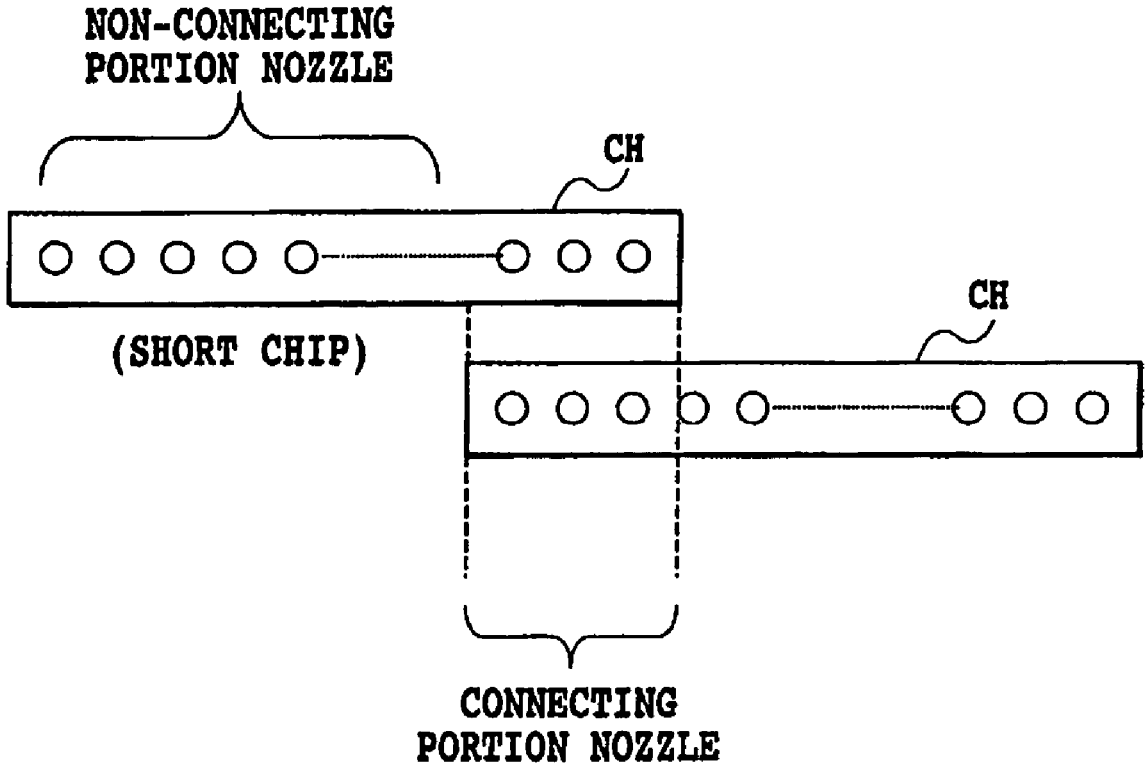
FIG. 18 is an enlarged diagram of a chip shown in FIG. 17.
Figure 19:
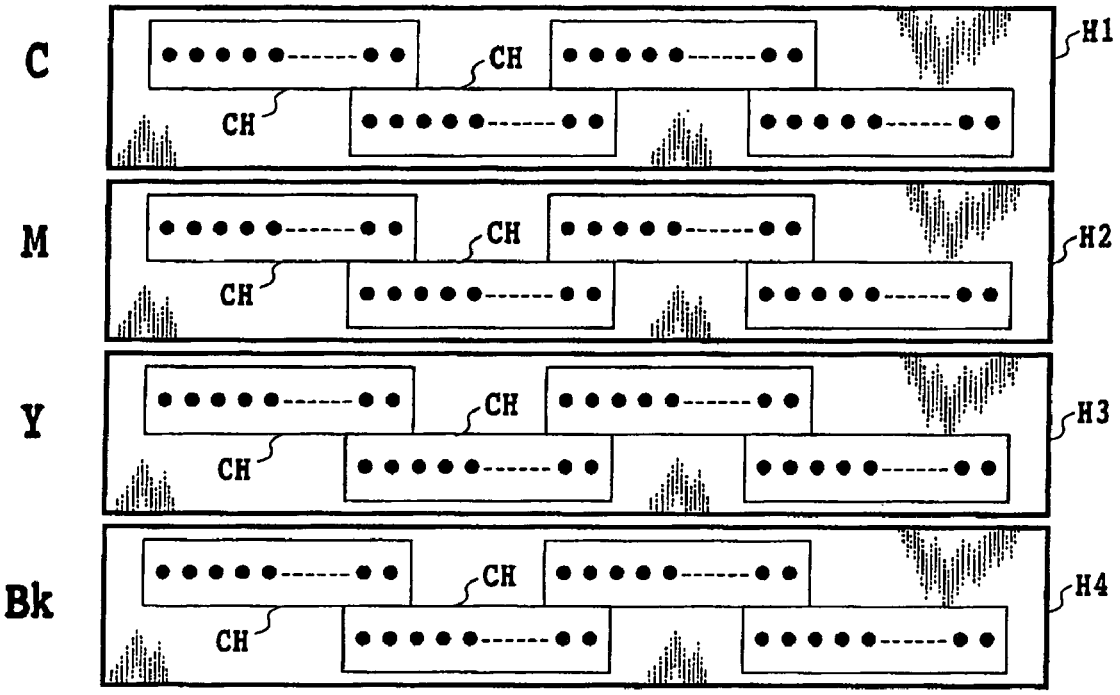
FIG. 19 is a diagram showing a conventional connecting head for forming a color image in four colors.
Figure 20:
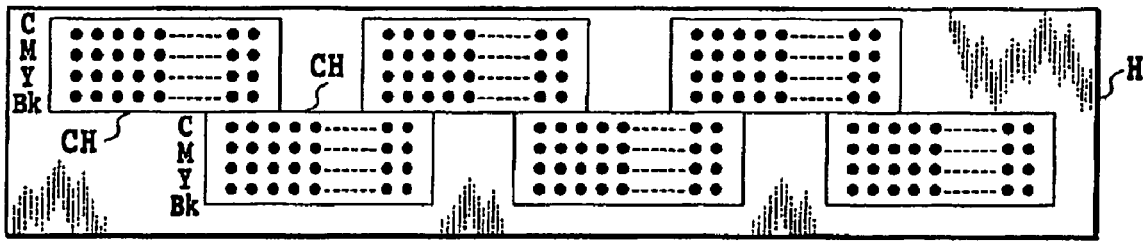
FIG. 20 is a diagram showing another example of a conventional connecting head for forming a color image.
Figure 21:
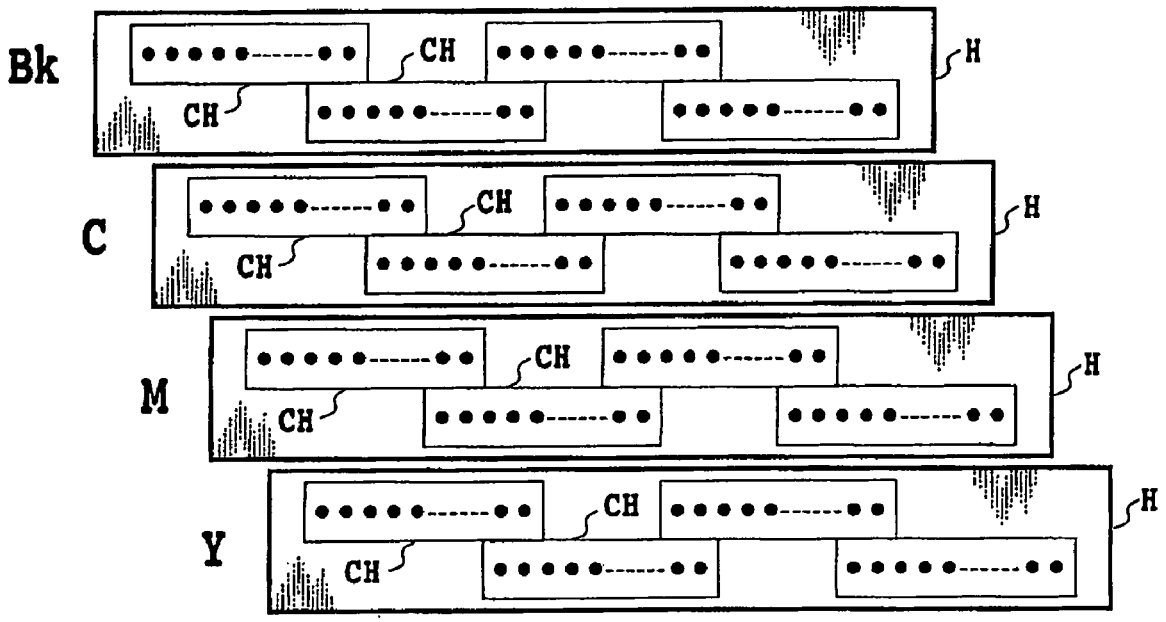
FIG. 21 is a diagram showing another example of a conventional connecting head for forming a color image.
Figure 22:
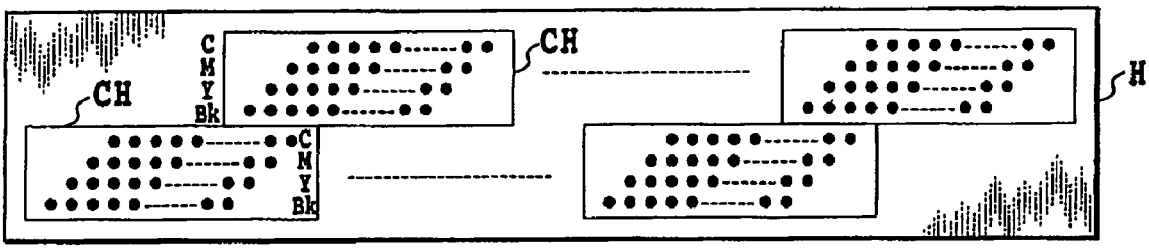
FIG. 22 is a diagram showing another example of a conventional connecting head for forming a color image.
Figure 23:
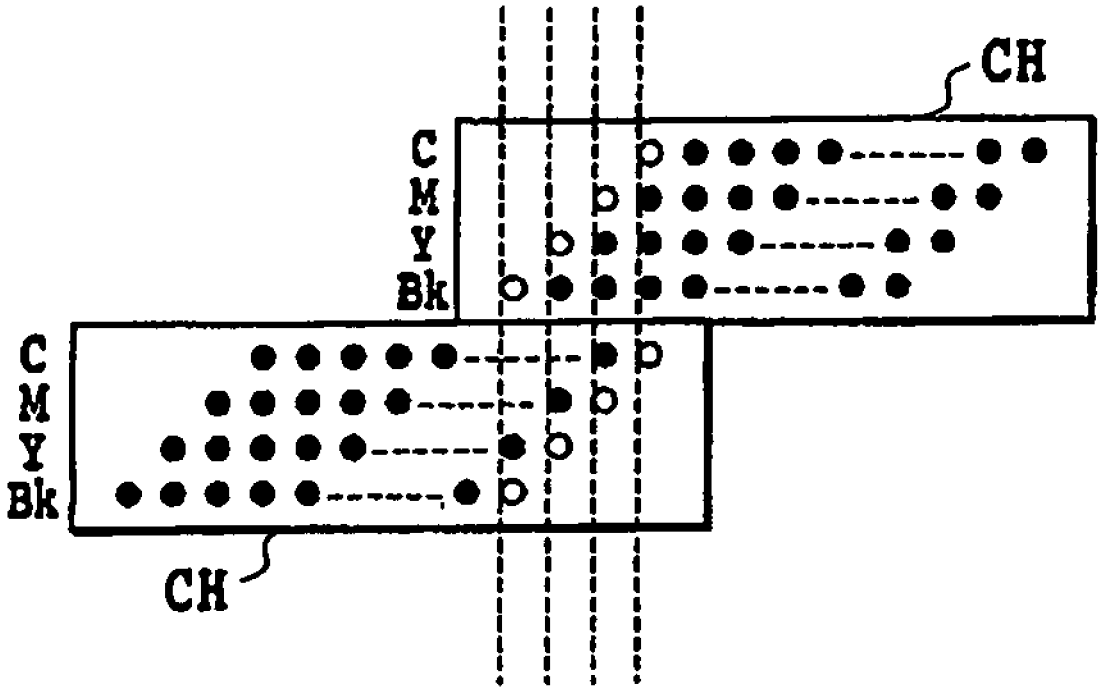
FIG. 23 is an enlarged diagram of a chip shown in FIG. 22.

Now, a fifth embodiment of the present invention will be described with reference to FIGS. 15, 16A, and 16B. FIG. 15 is a diagram showing each of the chips in the print head used in the fifth embodiment as well as the arrangement of the nozzles in the chip. FIG. 16A is an enlarged diagram of the chip shown in FIG. 15. FIG. 16B is a diagram illustrating the arrangement of dots formed in accordance with the fifth embodiment.

The print head H used in the fifth embodiment is a connecting head comprising chips staggered and connected together along the nozzle arranging direction (X direction) and each having two arrays of ejection openings (nozzle arrays). In the figure, CH1 denotes a chip located upstream in the print media conveying direction (Y direction). CH2 denotes a chip located downstream in the same direction. The chips CH1 and CH2 are connected together so as to overlap partly. In each chip, NA denotes a nozzle array located upstream in the Y direction. NB denotes a nozzle array located downstream in the same direction. In each chip, the leading ends of the nozzle arrays NA and NB are located at different positions. In the upstream chip CH1, the upstream nozzle array NA is longer than the downstream nozzle array NB by a distance corresponding to several (in the figure, four) nozzles. In the downstream chip CH2, the downstream nozzle array NB is longer than the upstream nozzle array NA by a distance corresponding to several (in the figure, four) nozzles. In the upstream nozzle array NA, nozzles with internal diagonal lines are used. In the downstream nozzle array NB, nozzles with internal nodal lines are used. Joining portion nozzles in the chips CH1 and CH2 are denoted by na. The other nozzles, the non-connecting portion nozzles, are denoted by nb.

With the print head configured as described above, each raster is printed using the nozzle arrays NA and NB in each of the chips CH1 and CH2. If a raster is formed at a position where the connecting portion nozzle na in one of the chips CH1 and CH2 is opposite an unused nozzle in the other chip, dots are formed by alternately using the non-connecting portion nozzles nb in the upstream nozzle array NA and the non-connecting portion nozzles nb in the downstream nozzle array NB. To form rasters L1 and L2 corresponding to the connecting portions in the head chips, each of the connecting portion nozzles na and the opposite non-connecting portion nozzle nb are controlled in accordance with the printing conditions as in the case of the first to third embodiments. This enables the reduction of possible white stripes between the adjacent rasters L1 and L2. For example, as shown in FIG. 16B, control is performed by reducing the number of ink droplets from the connecting portion nozzle na in one of the chips, while increasing the number of ink droplets ejected from the non-connecting portion nozzle nb in the other chip located so as to overlap the connecting portion nozzle na. It is thus possible to make white stripes between the adjacent rasters L1 and L2 unnoticeable.

White stripes can be prevented from occurring between the adjacent rasters L1 and L2, by performing the following control: the ejection amounts of both non-connecting portion nozzles nb are increased while alternately using the connecting portion nozzle na in one of the chips and the non-connecting portion nozzle nb in the other chip located so as to overlap the connecting portion nozzle na, or in addition to this control, a reduction in the ejection amount of the connecting portion nozzle na is carried out, as in the case of the second embodiment.

The ejection amount control may be combined with the control of the number of ink droplets ejected as in the case of the third embodiment.

Other Embodiments

In the description of the above embodiments, the heaters are used as means for generating energy required to eject ink droplets from the print head. However, this means may be electromechanical conversion elements such as piezoelectric elements instead of electrothermal elements such as heaters.

The present invention is applicable to all the apparatuses using print media such as paper, cloth, leather, nonwoven fabrics, or metal. Specific applicable apparatuses include business and office machines, such as a printer, a copier, and a facsimile machine, as well as industrial production machines.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2005-086720 filed Mar. 24, 2005, which is hereby incorporated by reference herein.

What is claimed is:

1. An ink jet printing apparatus comprising a print head including a plurality of chips each having at least one nozzle array of a plurality of nozzles through which the same color ink is ejected, the chips being connected together along a direction in which the nozzles are arranged, the print head further including connecting portion nozzles that connect a nozzle array in each chip to a nozzle array in an adjacent chip and non-connecting portion nozzles different from the connecting portion nozzles, the ink jet printing apparatus forming an image by allowing ink droplets to be ejected from the nozzles while relatively moving the print head and print media in a direction crossing the nozzle array arranging direction, wherein a plurality of different nozzle arrays are provided in the print head in the crossing direction, the connecting portion nozzles in one of the nozzle arrays overlaps the non-connecting portion nozzles in another nozzle array, and control means controls ejection of ink droplets through the non-connecting portion nozzles in accordance with printing conditions when the connecting portion nozzles and the non-connecting portion nozzles are used to form the same raster extending in the relative moving direction.

2. The ink jet printing apparatus according to claim 1, wherein the control means controls the amount of ink per droplet from at least one of the non-connecting portion nozzles and the connecting portion nozzles.

3. The ink jet printing apparatus according to claim 1, wherein the control means controls the number of ink per droplets ejected from at least one of the non-connecting portion nozzles and the connecting portion nozzles.

4. The ink jet printing apparatus according to claim 1, wherein the print head has chips each comprising one array of the plurality of nozzles and staggered along the nozzle arranging direction.

5. The ink jet printing apparatus according to claim 1, wherein the print head has chips each comprising plural arrays each of the plurality of nozzles, the arrays being arranged in a direction in which the print media is conveyed and having different lengths, the chips being staggered along the nozzle arranging direction.

6. The ink jet printing apparatus according to claim 1, wherein a single end nozzle is located at at least one end of each nozzle array as one of the connecting portion nozzles.

7. The ink jet printing apparatus according to claim 1, wherein a plurality of nozzles are located at at least one end of each nozzle array and in the vicinity of the end as the connecting portion nozzles.

8. The ink jet printing apparatus according to claim 7, wherein the control means reduces the amount of ink ejected through those of the plurality of connecting nozzles which are closer to the end nozzles, and increases the amount of ink ejected through those of the plurality of non-connecting portion nozzles located at the same position as that of the end nozzle in the nozzle arranging direction which correspond to the connecting portion nozzles with a reduced amount of ink ejected.

9. The ink jet printing apparatus according to claim 1, wherein the control means uses, as a printing condition, at least one of a speed at which printing is executed on print media using the print head, a print duty per unit area of the print media, the type of the print media, and the type of ink, and controls at least the non-connecting portion nozzles in connection with an operation of ejecting ink droplets, in accordance with the printing condition.

10. The ink jet printing apparatus according to claim 9, wherein the amount of ink ejected to the print media through the non-connecting portion nozzles is increased consistently with at least one of the printing speed and the print duty.

11. The ink jet printing apparatus according to claim 9, wherein the amount of ink ejected to the print media through the non-connecting portion nozzles is increased while the amount of ink ejected to the print media through the connecting portion nozzles is reduced, with an increase in at least one of the printing speed and the print duty.

12. The ink jet printing apparatus according to claim 9, wherein the control means increases or reduces the amount of ink ejected to the print media through the non-connecting portion nozzles, consistently with diffusibility of ink on the print media.

13. An ink jet printing method comprising a print head including a plurality of chips each having at least one nozzle array of a plurality of nozzles through which the same color ink is ejected, the chips being connected together along a direction in which the nozzles are arranged, the print head further including connecting portion nozzles that connect a nozzle array in each chip to a nozzle array in an adjacent chip and non-connecting portion nozzles different from the connecting portion nozzles, the ink jet printing method forming an image by allowing ink droplets to be ejected from the nozzles while relatively moving the print head and print media in a direction crossing the nozzle head arranging direction, wherein a plurality of different nozzle arrays are provided in the print head in the crossing direction, the connecting portion nozzles in one of the nozzle arrays overlap the non-connecting portion nozzles in the other nozzle array, and a control step controls ejection of ink droplets through the non-connecting portion nozzles in accordance with printing conditions when the connecting portion nozzles and the non-connecting portion nozzles are used to form the same raster extending in the relative moving direction.

* * * * *

UNITED STATES PATENT AND TRADEMARK OFFICE

CERTIFICATE OF CORRECTION

PATENT NO. : 7,380,896 B2
APPLICATION NO. : 11/378489
DATED : June 3, 2008
INVENTOR(S) : Satoshi Wada It is certified that error appears in the above-identified patent and that said Letters Patent is hereby corrected as shown below:

COLUMN 2:
Line 57, “inks, a” should read -- inks, namely, --.

COLUMN 3:
Line 32, “2000-289233)” should read -- 2000-289233). --.

COLUMN 9:
Line 14, “main-pulse” should read -- main pulse --.
Line 28, “pre-pulse PH,” should read -- pre-pulse $PH_1$ --.
Line 54, “$PH_l$” should read -- $PH_1$ --.

COLUMN 12:
Line 66, the second occurrence of “also” should be deleted.

COLUMN 13:
Line 41, “serve” should read -- serves --.
Line 67, “(f or” should read -- (for --.

COLUMN 15:
Line 6, “embodiment,” should read -- embodiments, --.
Line 54, “nozzle” should read -- nozzles --.

COLUMN 16:
Line 65, “ink per” should read -- ink --.

Signed and Sealed this

Third Day of March, 2009

John Doll

JOHN DOLL
*Acting Director of the United States Patent and Trademark Office*